US008861777B2

(12) United States Patent
Yang

(10) Patent No.: US 8,861,777 B2
(45) Date of Patent: Oct. 14, 2014

(54) VIBRATING ELEMENT

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 48 days.

(21) Appl. No.: 13/735,041

(22) Filed: Jan. 7, 2013

(65) Prior Publication Data

US 2014/0133690 A1 May 15, 2014

(30) Foreign Application Priority Data

Nov. 13, 2012 (TW) ..... 101142279 A

(51) Int. Cl.
*H04R 1/02* (2006.01)
*H04R 9/02* (2006.01)
*H04R 7/10* (2006.01)

(52) U.S. Cl.
CPC .. *H04R 9/02* (2013.01); *H04R 7/10* (2013.01); *H04R 2307/027* (2013.01)
USPC ..... 381/409; 381/410; 381/423; 381/426; 381/427

(58) Field of Classification Search
CPC ..... H04R 1/06; H04R 9/00
USPC ..... 381/407–410, 423, 426–427
See application file for complete search history.

(56) References Cited

U.S. PATENT DOCUMENTS 3,134,074 A * 5/1964 Litke ..... 455/100
4,281,223 A 7/1981 Ugaji et al.
4,376,233 A * 3/1983 Kamon et al. ..... 381/409
6,553,126 B2 * 4/2003 Han et al. ..... 381/409
6,680,707 B2 * 1/2004 Allen et al. ..... 343/718
6,993,147 B2 * 1/2006 Guenther ..... 381/407
7,023,389 B2 * 4/2006 Demicco et al. ..... 343/702
7,221,773 B2 * 5/2007 Takahashi ..... 381/430
7,551,894 B2 * 6/2009 Gerber et al. ..... 455/41.2
7,933,429 B2 4/2011 Lutz
8,180,097 B2 * 5/2012 Harms et al. ..... 381/400
2004/0086149 A1 5/2004 Johannsen et al.
2004/0141629 A1 * 7/2004 Liao ..... 381/400

(Continued)

FOREIGN PATENT DOCUMENTS

JP 62040898 A * 2/1987 ..... H04R 7/02
JP 07-038993 2/1995
WO 2011086301 7/2011

OTHER PUBLICATIONS

"Search Report of Europe Counterpart Application", issued on Apr. 23, 2013, p. 1-p. 7.

(Continued)

*Primary Examiner* — Curtis Kuntz
*Assistant Examiner* — Ryan Robinson
(74) *Attorney, Agent, or Firm* — Jianq Chyun IP Office

(57) ABSTRACT

A vibrating element includes a diaphragm and a voice coil. The diaphragm has a first surface and a second surface opposite to each other, in which the first surface includes a first conductive region and a second conductive region separated from the first conductive region. The voice coil is disposed at the first surface of the diaphragm, in which two ends of the voice coil are respectively electrically connected to the first conductive region and the second conductive region, and the two ends of the voice coil are located within a region circled by the voice coil on the first surface.

11 Claims, 5 Drawing Sheets

(56) References Cited

U.S. PATENT DOCUMENTS

| | | | | |
|---|---|---|---|---|
| 2005/0031152 | A1 | 2/2005 | Hansen et al. | |
| 2010/0183173 | A1* | 7/2010 | Teske-Fischer et al. | 381/151 |
| 2010/0304704 | A1* | 12/2010 | Najafi | 455/404.1 |
| 2012/0075151 | A1* | 3/2012 | Jenwatanavet et al. | 343/718 |
| 2012/0231737 | A1* | 9/2012 | Ponce De Leon et al. | 455/41.2 |

OTHER PUBLICATIONS

"Office Action of Germany counterpart application" with English translation thereof, issued on Jul. 8, 2013, p. 1-p. 6.

* cited by examiner

Replacement Sheet

VIBRATING ELEMENT

CROSS-REFERENCE TO RELATED APPLICATION

This application claims the priority benefit of Taiwan application serial no. 101142279, filed on Nov. 13, 2012. The entirety of the above-mentioned patent application is hereby incorporated by reference herein and made a part of this specification.

BACKGROUND

1. Field of the Disclosure

The disclosure generally relates to a vibrating element, and more particularly, to a vibrating element used in a speaker unit.

2. Description of Related Art

With the continuous advances in technology, electronic products are all developed toward lightweight and miniaturization, and people can use the mini electronic products, such as radio or Walkman anytime and anywhere. In addition, due to the growing popularity of personal digital products, such as common MP3 player, mobile phone, personal digital assistant (PDA) or notebook computer, they are indispensable for daily life. Among the above-mentioned electronic products, the smart phone able to provide a variety of audio and video entertainments becomes more popular.

Regardless of what electronic products they are, in order to allow the user to listen to sound information provided by an electronic product without disturbing other people, the earphone has become a necessary accessory of the electronic product. In addition, the earphone also provides a better sound transmission for a listener; with an earphone, the listener can clearly hear and understand the sound content, unlike hearing the sound transmitted in the air with unclear quality, and in particular during movement of the user, for example, in sporting, riding, drastic activity or noise environment, the sound quality would not be affected.

In the speaker unit of a conventional earphone, the lead wires of two ends of a voice coil for driving the diaphragm of the speaker directly across the diaphragm and connect to a signal source at the periphery of the diaphragm, and the lead wires are further coated with a lead protection glue. The lead wires that across the diaphragm will seriously affect the vibration of the diaphragm, thereby deteriorate the frequency response performance of the speaker unit and make poor sound quality. Thus, U.S. Pat. No. 7,933,429 proposes a vibrating element with the architecture of FIG. 1A. Referring to FIG. 1A, a coil 5 is disposed in a recess 4 of a diaphragm 2, and two ends 6*a* and 6*b* of the coil 5 contact two conductive areas 3*a* and 3*b* on the diaphragm 2. Thereby, the ends 6*a* and 6*b* of the coil 5 across the diaphragm 2 can be avoided from affecting the vibration of the diaphragm 2 to enhance the sound quality. However, it is not easy to form the recess 4 able to accommodate the coil 5 on the diaphragm 2, and the smaller the dimension of the speaker unit, the larger the degree of difficulty to form the recess 4 will be.

FIG. 1B is a schematic diagram of a speaker unit provided by US Patent Application No. 2010/0183173. Referring to FIG. 1B, coil 20 is directly disposed on a diaphragm 10, while the coil 20 is electrically connected to the metalized surface 11 of the diaphragm 10. Then, two circuits 15 are overlapped at the edge of the diaphragm 10 to be electrically connected to the metalized surface 11. However, the lap of the circuits 15 on the edge of the diaphragm 10 will still affect the vibration consistency of the diaphragm 10. On the other hand, two ends

25 of the coil 20 are connected to the metalized surface 11 at the periphery of the coil 20. Since the hardness of the connection points at two ends 25 of the coil is significantly different from the hardness of the diaphragm 10, and the part of the diaphragm at the periphery of the coil 20 must be soft to substantially vibrate for providing the low-frequency sounds, therefore, the connection points at two ends 25 of the coil will significantly destroy the vibration consistency of the diaphragm 10 at the above-mentioned area and thereby deteriorate the sound quality.

SUMMARY OF THE DISCLOSURE

Accordingly, the disclosure is directed to a vibrating element able to solve the problem of the voice coil affecting the vibration of the diaphragm.

The disclosure provides a vibrating element, which includes a diaphragm and a voice coil. The diaphragm has a first surface and a second surface opposite to each other, in which the first surface includes a first conductive region and a second conductive region separated from the first conductive region. The voice coil is disposed at the first surface of the diaphragm, in which two ends of the voice coil are respectively electrically connected to the first conductive region and the second conductive region, and the two ends of the voice coil are located within a region circled by the voice coil on the first surface.

In an embodiment of the disclosure, a first conductive layer is disposed at the first conductive region and a second conductive layer is disposed at the second conductive region.

In an embodiment of the disclosure, the two ends of the voice coil are respectively electrically connected to the first conductive region and the second conductive region via conductive adhesive.

In an embodiment of the disclosure, the vibrating further includes a frame, a first terminal and a second terminal. The frame has a first side and a second side opposite to the first side, in which the diaphragm is disposed at the first side of the frame. The first terminal is disposed between the first side of the frame and the diaphragm and electrically connected to the first conductive region. The second terminal is disposed between the first side of the frame and the diaphragm and electrically connected to the second conductive region.

In an embodiment of the disclosure, the first terminal and the second terminal are circuit on a flexible circuit board, and one end of each of the first terminal and the second terminal is folded following the flexible circuit board to the second side of the frame.

In an embodiment of the disclosure, the first terminal and the second terminal are partially inserted in the frame, and one end of each of the first terminal and the second terminal goes through the frame to be exposed at the second side of the frame.

In an embodiment of the disclosure, the frame, the first terminal and the second terminal are formed in insert molding process.

In an embodiment of the disclosure, the frame further has a plurality of through holes.

In an embodiment of the disclosure, the first terminal and the second terminal respectively contact in surface the first conductive region and the second conductive region.

Based on the description above, in the vibrating element of the disclosure, two ends of the voice coil are located within a region circled by the voice coil on the diaphragm.

The circled region is a high-frequency sound generating region with small sounding amplitude and high rigidity, so that when the connection points of the voice coil are placed at the region, the part of the diaphragm mainly for vibrating and sounding is not affected, which can advance the sound quality.

In order to make the features and advantages of the present disclosure more comprehensible, the present disclosure is further described in detail in the following with reference to the embodiments and the accompanying drawings.

DESCRIPTION OF THE EMBODIMENTS

Figure 1A:
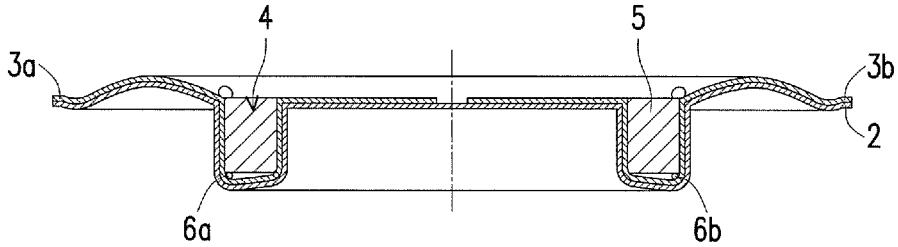
FIG. 1A (RELATED ART)
FIG. 1A is a schematic diagram of a speaker unit according to U.S. Pat. No. 7,933,429.
Figure 1B:
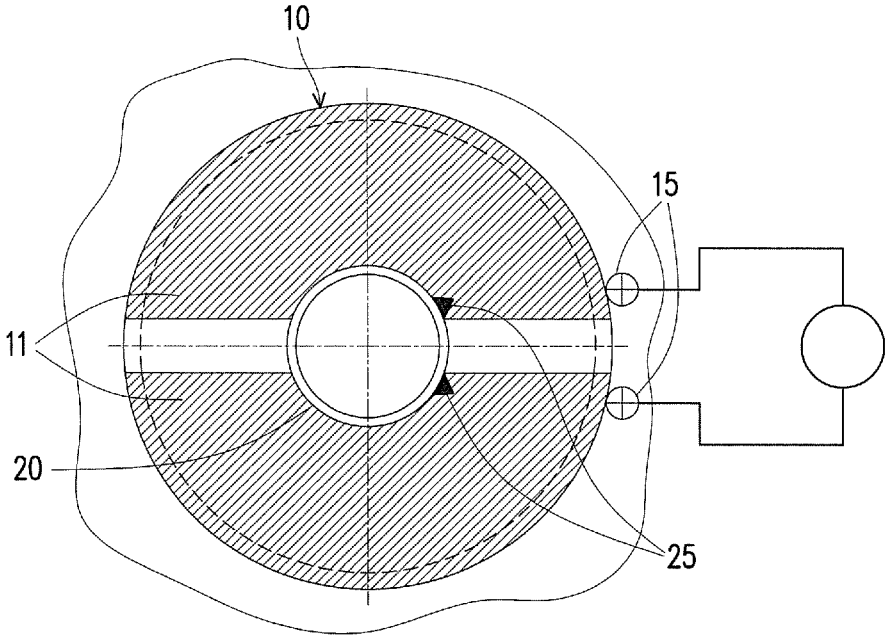
FIG. 1B (RELATED ART)
FIG. 1B is a schematic diagram of a speaker unit according to US Patent Application No. 2010/0183173.
Figure 2:
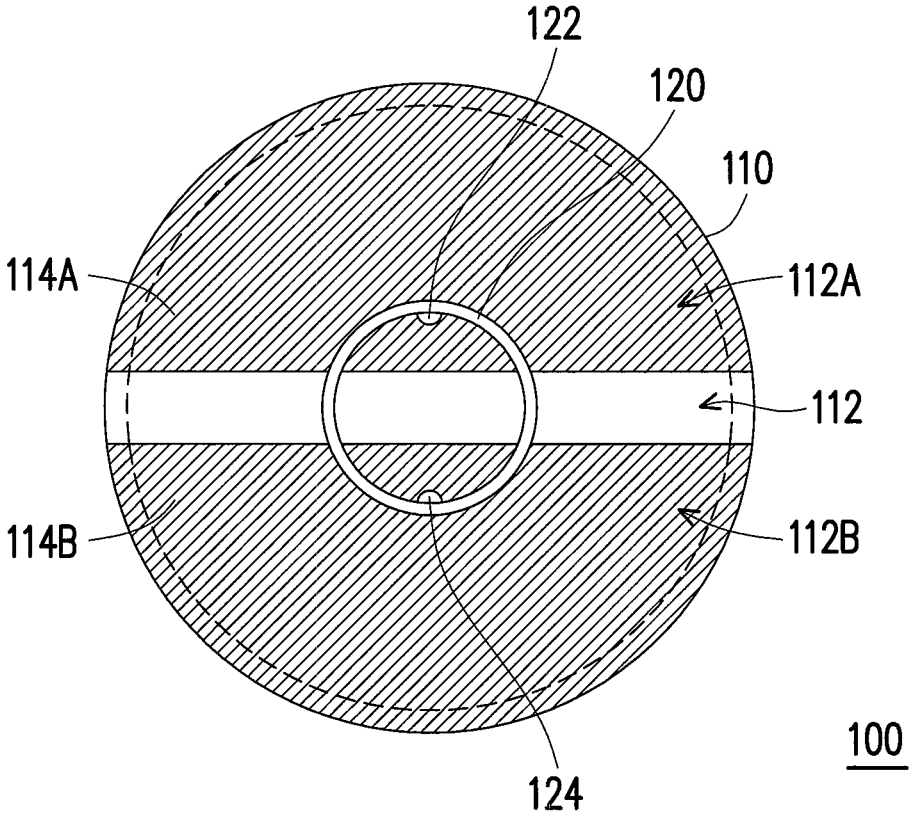
FIG. 2 is a front-view diagram of a vibrating element according to an embodiment of the disclosure.

FIG. 2 is a front-view diagram of a vibrating element according to an embodiment of the disclosure. Referring to FIG. 2, a vibrating element 100 of the embodiment includes a diaphragm 110 and a voice coil 120. The diaphragm 110 has a first surface 112 and a second surface opposite to each other. In FIG. 2, the angle of view is perpendicular to the first surface 112 so that the second surface is invisible in the figure. The first surface 112 includes a first conductive region 112A and a second conductive region 112B separated from each other. The voice coil 120 is disposed at the first surface 112 of the diaphragm 110. One end 122 of the voice coil 120 is electrically connected to the first conductive region 112A, while the other end 124 of the voice coil 120 is electrically connected to the second conductive region 112B. The two ends 122 and 124 of the voice coil 120 are located within a region circled by the voice coil 120 on the first surface 112.

In the vibrating element 100 of the embodiment, the two ends 122 and 124 of the voice coil 120 are located within the region circled by the voice coil 120, therefore, during vibrating of the diaphragm 110, only the part within the region circled by the voice coil 120 is affected by the two ends 122 and 124 of the voice coil 120, which largely reduces the influence on the sound quality during vibrating of the diaphragm 110. In addition, the available vibration amplitude within the region circled by the voice coil 120 on the diaphragm 110 is less than the amplitudes at the other parts of the diaphragm 110. In other words, the original rigidity of the region circled by the voice coil 120 on the diaphragm 110 is relative high. In comparison with the prior art where the two ends of the voice coil are disposed outside the region circled by the voice coil on the diaphragm, the influence of the two ends 122 and 124 of the voice coil 120 on the region circled by the voice coil 120 on the diaphragm 110 is smaller.

The first conductive region 112A and the second conductive region 112B in the embodiment are separated by a line-shaped nonconductive region, and the first conductive region 112A and the second conductive region 112B are respectively in a semicircle-like shape. The shapes of the first surface 112, the first conductive region 112A or the second conductive region 112B certainly can be others depending on the requirement. A part of the first conductive region 112A and a part of the second conductive region 112B are located within the region circled by the voice coil 120 to facilitate the two ends 122 and 124 of the voice coil 120 respectively electrically connected to the first conductive region 112A and the second conductive region 112B. A first conductive layer 114A is disposed at the first conductive region 112A and a second conductive layer 114B is disposed at the second conductive region 112B in the embodiment. The first conductive layer 114A and the second conductive layer 114B are formed on the diaphragm 110 by using, for example, vapour deposition, sputtering, electroplating or other processes. The first conductive region 112A and the second conductive region 112B, however, can be wholly formed with a conductive material. The two ends 122 and 124 of the voice coil 120 are respectively electrically connected to the first conductive region 112A and the second conductive region 112B via, for example, a conductive adhesive (for example, silver glue).

In following, other embodiments are depicted. It should be noted that, the component notations and partial details of the structures hereinafter provided in the embodiments can be the same as or similar to the previous embodiment, wherein the same notations represent the same or similar components while the repeated same details are omitted, which can refer to the previous embodiment.

Figure 3A:
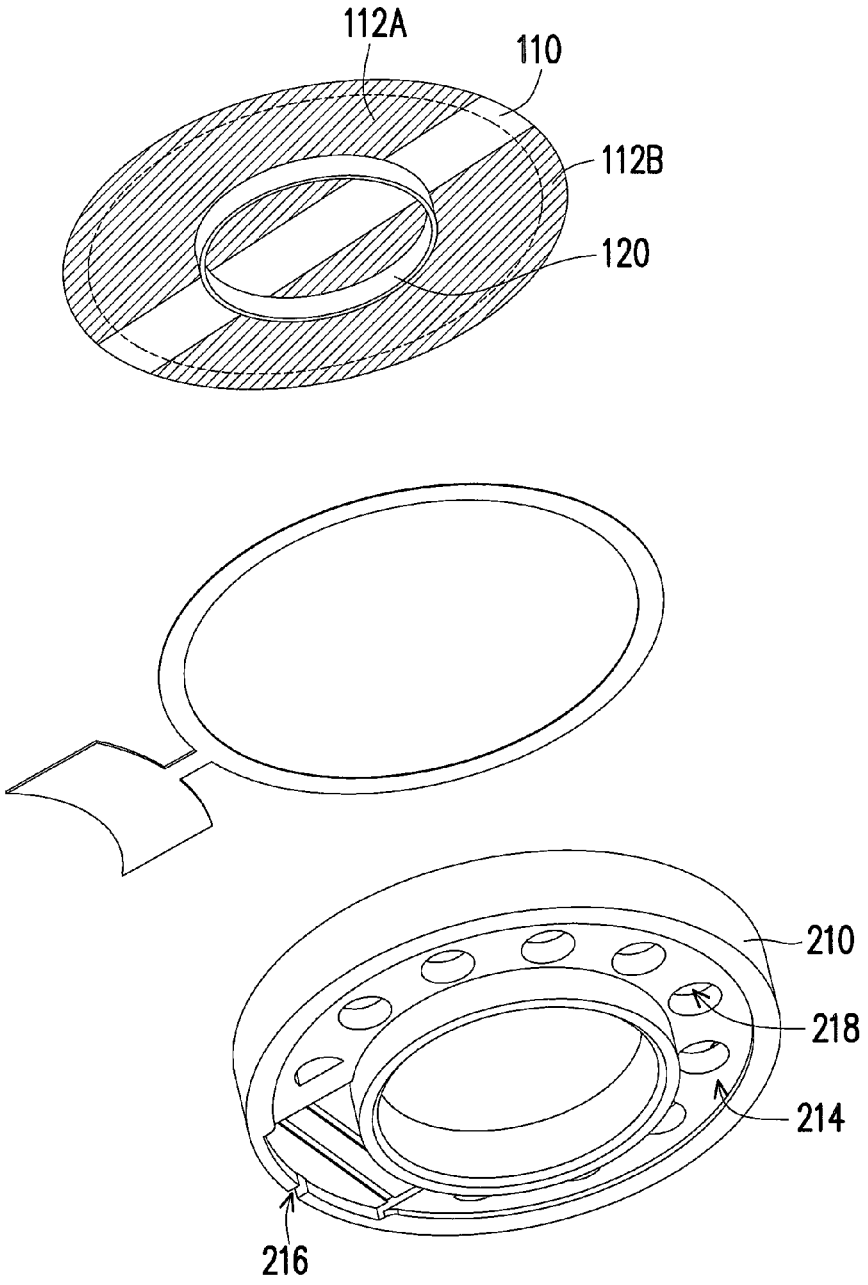
FIGS. 3A and 3B are exploded diagrams of a vibrating element according to another embodiment of the disclosure in two different angles of view.
Figure 3B:
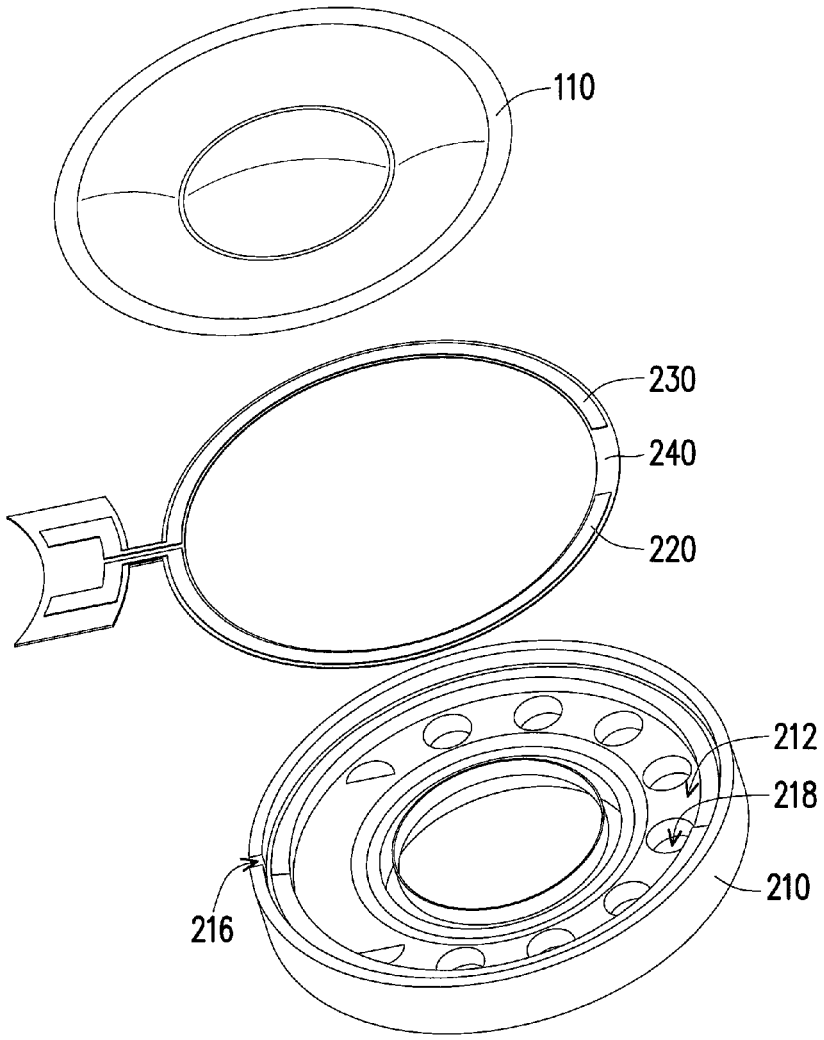

FIGS. 3A and 3B are exploded diagrams of a vibrating element according to another embodiment of the disclosure in two different angles of view. Referring to FIGS. 3A and 3B, a vibrating element 200 in the embodiment has the same diaphragm 110 and voice coil 120 as shown by FIG. 2, but further includes a frame 210, a first terminal 220 and a second terminal 230. The frame 210 has a first side 212 and a second side 214 opposite to the first side 212. The diaphragm 110 is disposed at the first side 212 of the frame 210. The first terminal 220 is disposed between the first side 212 of the frame 210 and the diaphragm 110 and electrically connected to the first conductive region 112A. The second terminal 230 is disposed between the first side 212 of the frame 210 and the diaphragm 110 and electrically connected to the second conductive region 112B.

The frame 210 is configured to support the diaphragm 110, while the signal of the external sound source can be imported to or output from the voice coil 120 through a conductive path formed by the first terminal 220, the second terminal 230, the first conductive region 112A and the second conductive region 112B. In the embodiment, the first terminal 220 contacts in surface the first conductive region 112A and the second terminal 230 contacts in surface the second conductive region 112B. It can be seen that the design adopted by the embodiment where the first conductive region 112A and the second conductive region 112B are disposed on the diaphragm 110 is further advantageous for easily assembling in the successive process.

The first terminal 220 and the second terminal 230 in the embodiment are the circuit on a flexible circuit board 240. As a result, an end of the first terminal 220 and an end of the second terminal 230 which do not contact the first conductive region 112A and the second conductive region 112B can be respectively folded to the second side 214 of the frame 210 following the flexible circuit board 240. After that, the ends of the first terminal 220 and the second terminal 230 both located at the second side 214 of the frame 210 are further connected to the external sound source. The side edge of the frame 210 in the embodiment has a notch 215 for the flexible circuit board 240 to be folded and pass through. In addition, the frame 210 can have a plurality of through holes 218 to allow the gas passing through during vibrating of the diaphragm 110.

Figure 4A:
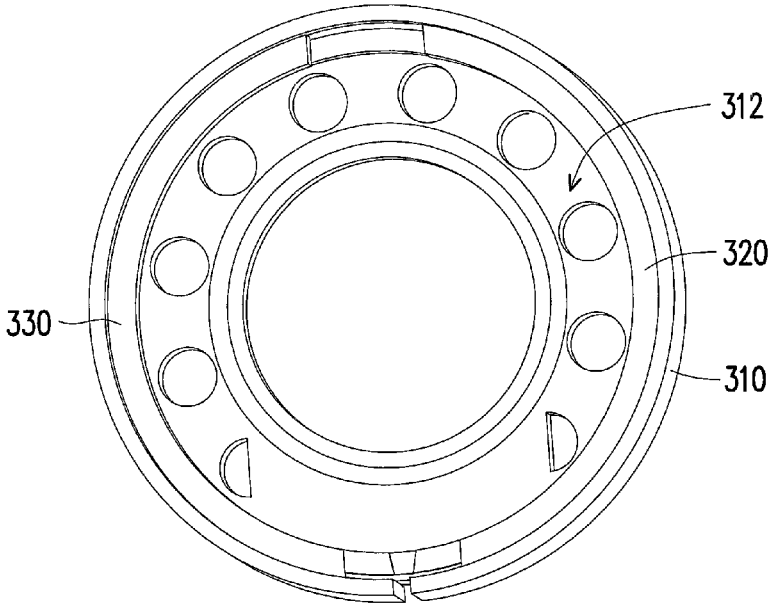
FIGS. 4A and 4B are exploded diagrams of the partial parts of a vibrating element according to yet another embodiment of the disclosure in two different angles of view.
Figure 4B:
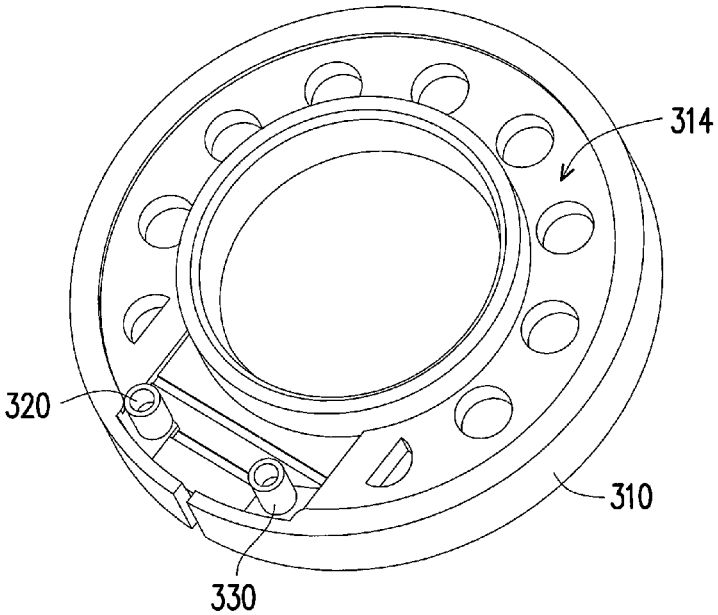

FIGS. 4A and 4B are exploded diagrams of the partial parts of a vibrating element according to yet another embodiment of the disclosure in two different angles of view. The vibrating element in the embodiment, same as the above-mentioned embodiments, comprises the diaphragm 110 and the voice coil 120 as shown by FIG. 2, but the first terminal 320 and the second terminal 330 in the embodiment are inserted in the frame 310, and an end of the first terminal 320 and an end of the second terminal 330 go through the frame 310 to be exposed at the second side 314 of the frame 310. As a result, the parts of the first terminal 320 and the second terminal 330 located at the first side 312 of the frame 310 can be electrically connected to the first conductive region 112A and the second conductive region 112B (shown in FIG. 2), while the other ends of the first terminal 320 and the second terminal 330 exposed at the second side 314 of the frame 310 can be electrically connected to the external sound source. The first terminal 320 and the second terminal 330 of the embodiment can be made, for example, of metal, followed by inserting the first terminal 320 and the second terminal 330 in the frame 310 during forming the frame 310 in insert molding process.

In summary, in the vibrating element of the disclosure, two ends of the voice coil are located within a region circled by the voice coil on the diaphragm, so that during the vibrating and the sounding of the diaphragm, the vibration and the sounding are less affected. By applying the vibrating element in a speaker unit in a product such as an earphone, the disclosure has better sound quality.

It will be apparent to those skilled in the art that the descriptions above are several preferred embodiments of the disclosure only, which does not limit the implementing range of the disclosure. Various modifications and variations can be made to the structure of the disclosure without departing from the scope or spirit of the disclosure. The claim scope of the disclosure is defined by the claims hereinafter.

What is claimed is:

1. A vibrating element, comprising:

a diaphragm, having a first surface and a second surface opposite to each other, wherein the first surface comprises a first conductive region and a second conductive region separated from the first conductive region; and a voice coil, disposed at the first surface of the diaphragm, wherein two ends of the voice coil are respectively electrically connected to the first conductive region and the second conductive region, and the two ends of the voice coil are located within a region circled by the voice coil on the first surface, wherein a part of the first conductive region and a part of the second conductive region are located within the region circled by the voice coil on the first surface.

2. The vibrating element as claimed in claim 1, wherein a first conductive layer is disposed at the first conductive region and a second conductive layer is disposed at the second conductive region.

3. The vibrating element as claimed in claim 1, wherein the two ends of the voice coil are respectively electrically connected to the first conductive region and the second conductive region via conductive adhesive.

4. The vibrating element as claimed in claim 1, further comprising:

a frame, having a first side and a second side opposite to the first side, wherein the diaphragm is disposed at the first side of the frame;

a first terminal, disposed between the first side of the frame and the diaphragm and electrically connected to the first conductive region; and a second terminal, disposed between the first side of the frame and the diaphragm and electrically connected to the second conductive region.

5. The vibrating element as claimed in claim 4, wherein the first terminal and the second terminal are circuit on a flexible circuit board, and one end of each of the first terminal and the second terminal is folded following the flexible circuit board to the second side of the frame.

6. The vibrating element as claimed in claim 4, wherein the first terminal and the second terminal are partially inserted in the frame, and one end of each of the first terminal and the second terminal goes through the frame to be exposed at the second side of the frame.

7. The vibrating element as claimed in claim 6, wherein the frame, the first terminal and the second terminal are formed in insert molding process.

8. The vibrating element as claimed in claim 4, wherein the frame further has a plurality of through holes.

9. The vibrating element as claimed in claim 4, wherein the first terminal and the second terminal respectively contact in surface the first conductive region and the second conductive region.

10. The vibrating element as claimed in claim 1, wherein the two ends of the voice coil do not pass through the diaphragm.

11. The vibrating element as claimed in claim 1, wherein the voice coil including the two ends of the voice coil is located on the first surface.

* * * * *